United States Patent [19]

Boyd

[11] 4,137,830

[45] Feb. 6, 1979

[54] BOX METERING SYSTEM

[75] Inventor: Jerry L. Boyd, Bakersfield, Calif.

[73] Assignee: Stanley A. McCluskey, Bakersfield, Calif.

[21] Appl. No.: 840,323

[22] Filed: Oct. 7, 1977

[51] Int. Cl.[2] ..... B31B 17/00; B65B 57/02; B65B 3/02

[52] U.S. Cl. ..... 93/55; 53/69; 53/250; 93/36.01

[58] Field of Search ..... 93/36 R, 36.01, 37 R, 93/39 R, 55 R; 53/67, 69, 185, 249, 250

[56] References Cited

U.S. PATENT DOCUMENTS 2,957,287 10/1960 Cella ..... 53/250 X

*Primary Examiner*—Travis S. McGehee

*Attorney, Agent, or Firm*—Poms, Smith, Lande, Glenny & Rose

[57] ABSTRACT

A box metering system for use with a box filling and weighing system in which a box forming machine discharges two-piece partially ensleeved box parts in partial assembled relation to a conveyor leading to the box filling and weighing stations. The box metering system includes a reciprocally movable box stop member which in one position stops a box and causes actuation of a box completion assembly device to complete the assembly of the box before advancement to a filling and weighing station. The completely assembled box is released by movement of the box stop member to a retracted position in response to movement of leading boxes toward the filling and weighing stations.

8 Claims, 7 Drawing Figures

BOX METERING SYSTEM

BACKGROUND OF INVENTION

In U.S. Pat. No. 4,010,594 issued Mar. 8, 1977, a demand feed box filling and weighing system is described in which formed boxes are advanced on a continuously moving conveyor belt toward box ready positions at which their advancement is stopped until the ready box is advanced to the weighing and filling station opposite its ready position or advanced to another box ready position opposite a box filling and weighing station in accordance with the demand of the weighing stations. Heretofore, such boxes were formed by hand; that is, boxes were received in flat condition with score lines to facilitate proper folding of the box into a box form. When boxes were manually formed, the number of assembled boxes on the box feed conveyor means generally slightly exceeded the demand for such boxes at the filling and weighing stations. In attempts to supply additional filling and weighing stations, manual forming of the boxes and feeding of the boxes to the stations was often inadequate and the filling and weighing stations could not be run at full capacity.

Attempts to solve this situation resulted in the design of automatic box forming machines in which a two-piece box was discharged from the box forming machine in a partially assembled relation; that is, one box part was only partially ensleeved within the other box part so that before such a partially assembly two-piece box could be passed to a filling station, the two parts have to be pressed into proper telescopic relation by "stuffing" one box part into its full telescopic completed assembled relation with the other box part. Such two-piece boxes include a polygonal section tube of paper board having open ends and a second box part telescopically received within the first box part with a bottom formed thereon so that when the two pieces are fully telescopically related, the flaps on the outer tube can be folded over to provide a top box wall. The automatic box forming machine is capable of supplying more than enough partially assembled boxes to such a demand feed weighing and filling box system. However, since the box feed conveyor includes a continuously moving belt from the automatic box forming machine to the filling and weighing stations, the continuous pressure of boxes in back-to-back relation sometimes caused unwanted displacement of boxes from their preselected box ready position opposite a filling and weighing station. In addition to some displacement of a box in box ready position, the boxes are in back-to-back relation and because of the long line of boxes on the box feed conveyor, the frictional pressure between back-to-back boxes becomes too great for ready separation of a box from the line of boxes by transverse movement into a filling and weighing station.

SUMMARY OF THE INVENTION

This invention relates to a box metering system for facilitating the conveyance and feeding of a plurality of boxes along a box feed conveyor means to a selected box filling and weighing station. The invention particularly relates to a box metering system adapted to complete assembly of a two part box and to regulate and control the flow of boxes along a box feed conveyor so that the unwanted displacement and frictional forces acting on boxes in back-to-back relation are avoided and obviated.

An object of the invention, therefore, is to provide a box metering system which regulates the flow of boxes from a selected location on a box feed conveyor means.

Another object of the invention is to provide a box metering system wherein completion of the assembly of two-part boxes is provided at the box flow control location.

A further object of the present invention is to provide a box metering system responsive to the need for boxes at box filling and weighing stations.

A further object of the invention is to provide a box metering system including a novel arrangement of switch means for regulating the completion of assembly of two-part boxes and the flow of assembled boxes to filling and weighing stations.

The invention contemplates a box metering system wherein as a partially assembled two-part box is stopped by a box stop member, switch means cause actuation of a piston and cylinder means to "stuff" or complete assembly of the two-part box. The metering device also includes switch means for causing retraction of said box stop member to release an assembled box as soon as the preceeding box has been advanced toward a box filling and weighing station.

Various other objects and advantages of the present invention will be readily apparent from the following description of the drawings in which an exemplary embodiment of the invention is shown.

Figure 1:
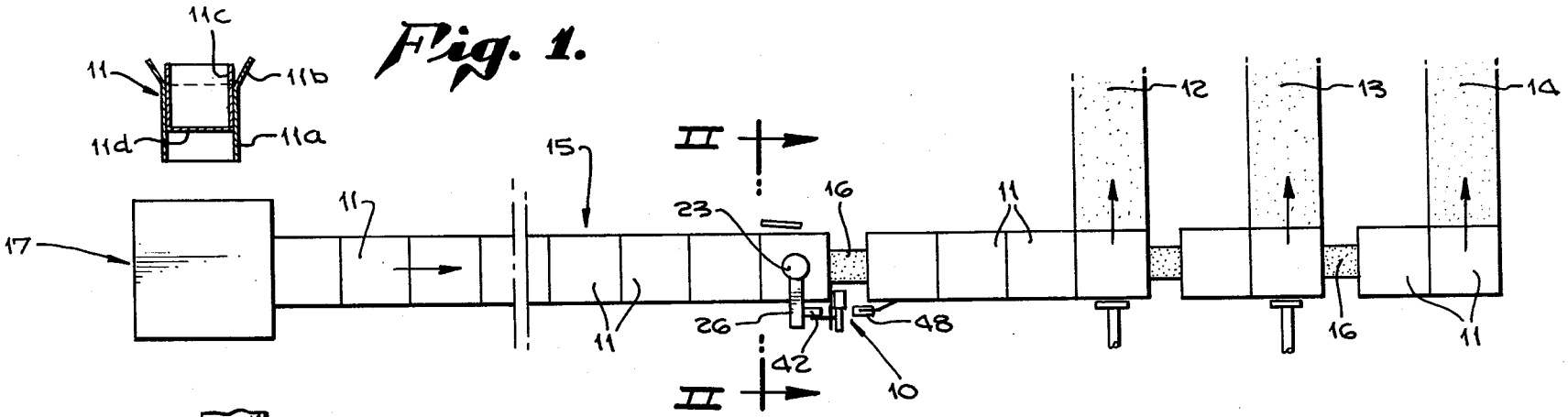
FIG. 1 is a schematic view of a box filling and weighing machine, a box feed conveyor means, and an automatic box forming machine with an example of the box formed in partial assembled relation thereabove, the box feed conveyor having a box metering device of this invention.
Figure 3:
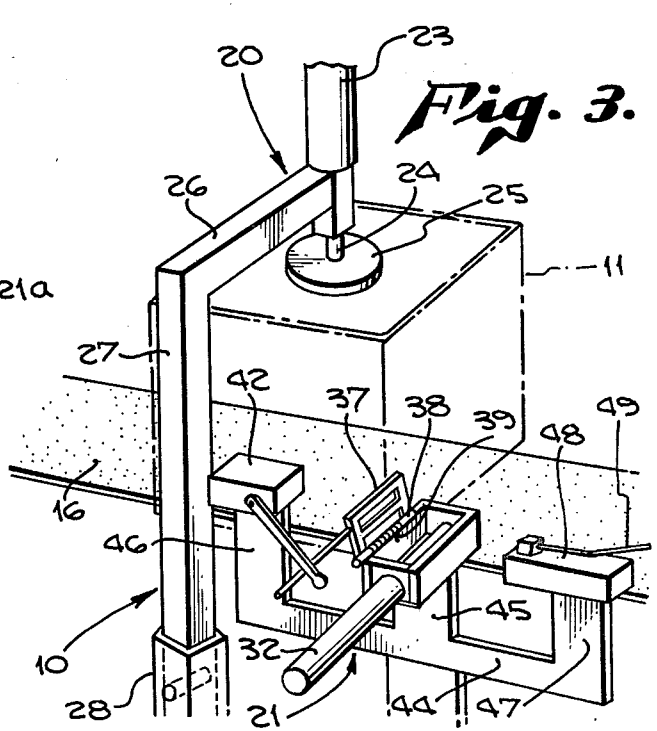
FIG. 3 is a fragmentary perspective view of a box metering system and box stopping means embodying the present invention.

In FIG. 1 of the drawings, a demand feed system of the type shown in U.S. Pat. No. 4,010,594, is schematically illustrated and is equipped with a box metering system of this invention generally indicated at 10. Boxes 11 are shown in back-to-back relation, except at the box metering device, and at box filling and weighing stations 12, 13 and 14. Boxes 11 are carried on a box feed conveyor means 15 comprising a continuously moving belt 16. An automatic box forming machine is generally indicated at 17 which discharges boxes in partially assembled relation. A partially assembled box 11 is illustrated above box forming machine 17 and comprises an outer tubular box sleeve **11*a* of rectangular section and having an open bottom end and an open top end defined by flaps 11*b*. Within the box sleeve part 11*a* is an inner box part 11*c* having a closed bottom 11*d*. When the box part 11*c*** is pushed or stuffed downwardly into final complete assembled relationship with the outer box part 11*a*, articles may be fed into the two part box through the top open end of the inner part 11*c* and when filled the box flaps 11*b* may be folded over to complete the box. Suitable hand holds, not shown, are provided in the box parts to prevent disassembly of the boxes when manually handled.

The box metering system 10 includes means 20 to complete assembly of the two-piece boxes and a means 21 to meter the flow of boxes along the conveyor after assembly of the boxes is completed by the box assembly means 20. Box completion assembly means 20 may comprise a vertically disposed fluid actuated piston and cylinder means 23 having a downwardly projecting piston rod 24 equipped with a disc or plunger 25 of selected diameter. The axis of piston rod 24 is located approximately at the vertical axis of a box which has been stopped by the box metering device 21 as later described. Cylinder means 23 may be suitably supported in overhanging position with respect to said boxes by a transversely disposed horizontal arm 26 supported by a vertically adjusted post 27 telescopically received within a correspondingly sectioned base member 28 suitably secured to the frame 29 of the conveyor means 15.

Cylinder means 23 is of double acting type and is connected to a suitable of pressure fluid such as compressed air. When actuated, the disc 25 is projected downwardly into a box to engage bottom wall 11*d* of the box and to push or stuff it downwardly until the inner box part 11*c* is fully received within the outer box part 11*a*. The disc 25 is retracted to a height which will permit boxes to pass therebeneath.

Figure 6:
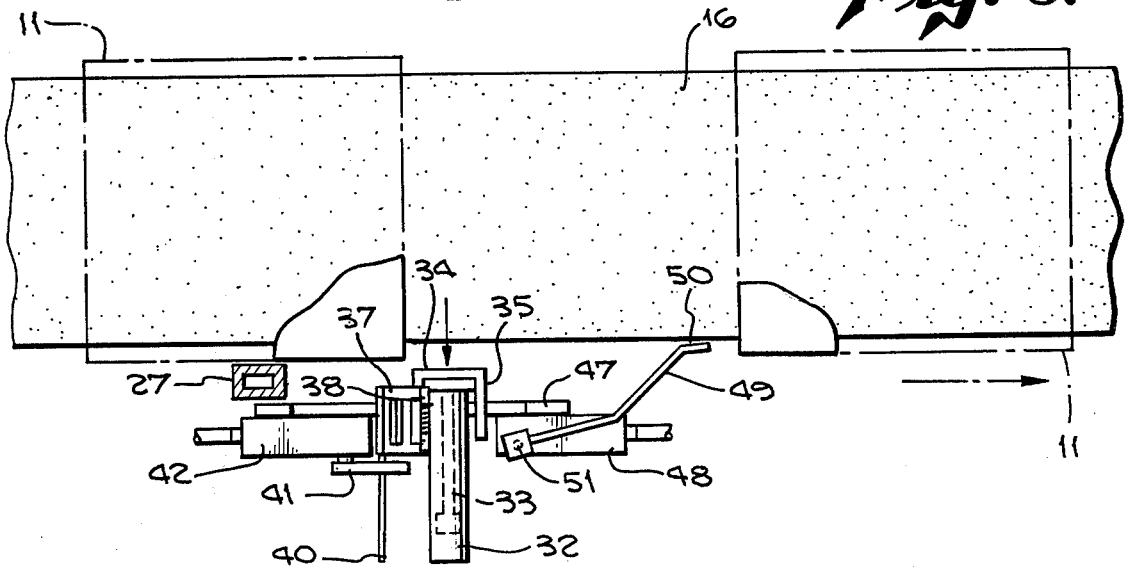
FIG. 6 is a fragmentary top plane view similar to FIG. 5, but showing the box metering device in retracted position.

Box metering device 21 comprises a pressure fluid actuated piston cylinder means 32 having a piston rod 33 to which is attached a U-shaped head 34. Head 34 includes parallel spaced side walls 35 lying in planes transverse to the conveyor means 15 and in retracted position being adapted to receive an end portion of the cylinder means 32 therebetween (FIG. 6). Side wall 35, which faces the oncoming boxes 11, is provided with an upstanding switch member 37 pivotally mounted at 38 on said side wall 35. Switch member 37 lies transversely to the box feed conveyor means 15 and is biased by a spring 39 towards the oncoming boxes. Switch member 37 is also provided with an outboardly extending switch contacting rod 40 which permits continual contact with a switch arm 41 of a switch means 42.

Figure 4:
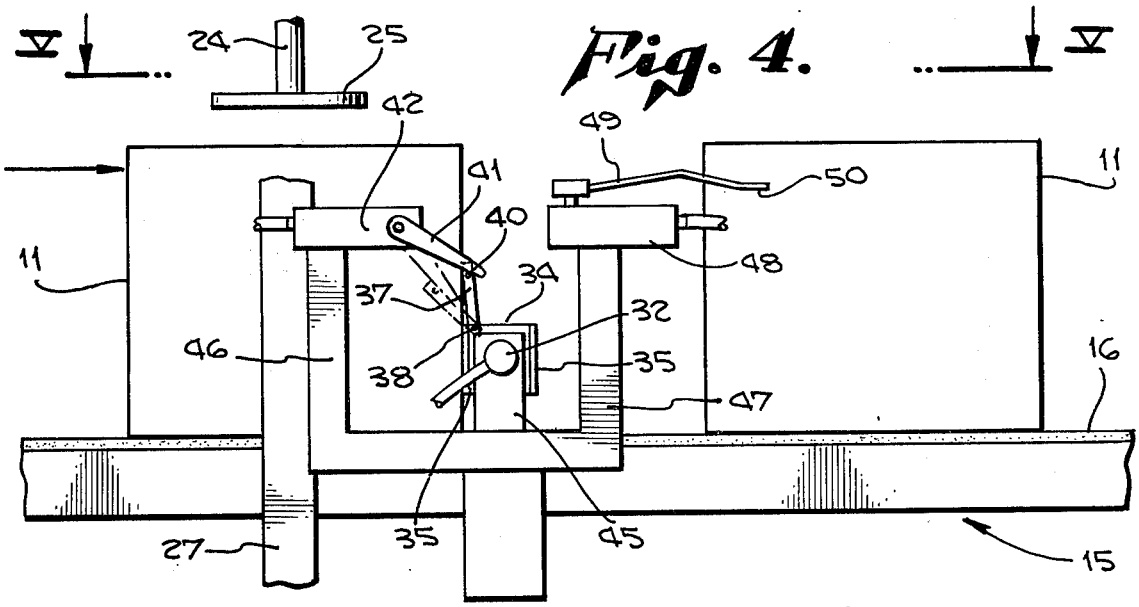
FIG. 4 is a fragmentary side elevational view of a box conveyor means and box metering system shown in FIG. 1.
Figure 5:
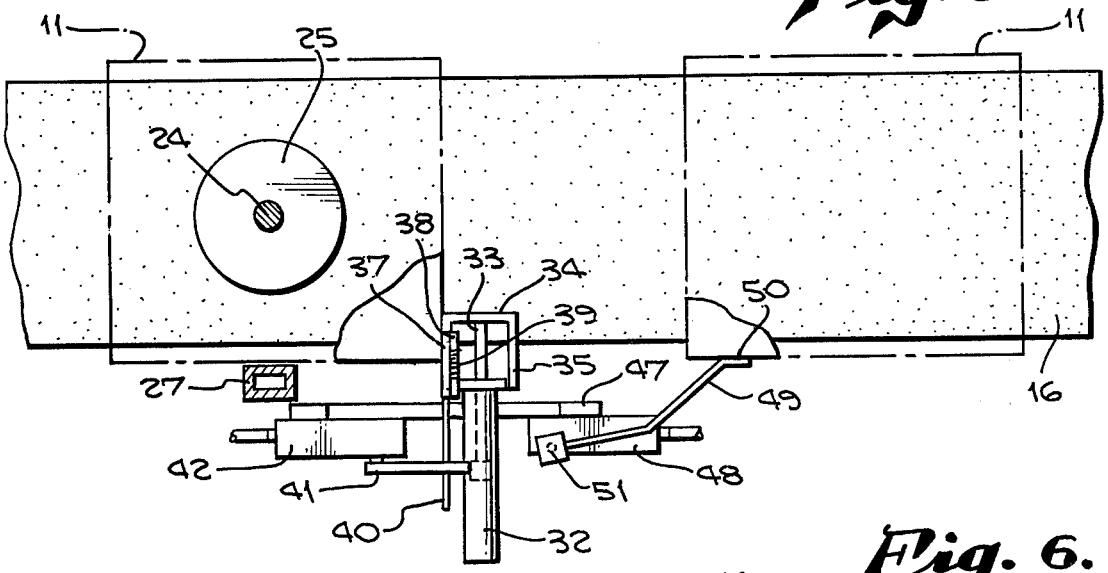
FIG. 5 is a fragmentary top plane view taken in the plane indicated by line V — V of FIG. 4 and showing the box metering means in projected box stop position.

Cylinder means 32 may be suitably mounted from the conveyor frame means by a support means 44 which includes a center support 45 for said cylinder means 32 and also support means 46 and 47 for switch means 42 and 48, respectively. Switch means 48 includes a box contacting arm 49 which extends in a downstream direction and is adapted to contact the side of a box as at 50, FIGS. 4 and 5.

Switch means 42 and 48 may be of any suitable type of switch and may include time delay means, not shown, to provide desired timed actuation of the box completion assembly means 20 and of the box stop means 21. Swtich arm 41 of switch means 42 may be engaged by rod 40 in projected and retracted position of cylinder means 32. Switch arm 49 is pivoted from switch means 48 as at 41 and is biased inboardly to provide sliding contact with the side wall of a box which has been released by the box metering device 21 and which is commencing to travel toward the box filling and weighing stations and which may be temporarily stopped at a position shown in FIGS. 4 and 5 becuase of the backup of boxes awaiting their turn at the box filling and weighing box ready positions.

In operation of the box metering system 10, it will be understood that the box forming machine 17 automatically discharges boxes formed as shown in FIG. 1 and that a further operation is required before the box can be filled, the further operation being the stuffing or pressing of the inner box part into its final assembled relationship with the outer box part. Boxes 11 are continuously advanced along box feed conveyor means 15 by the continuously moving conveyor belt 16.

Figure 7:
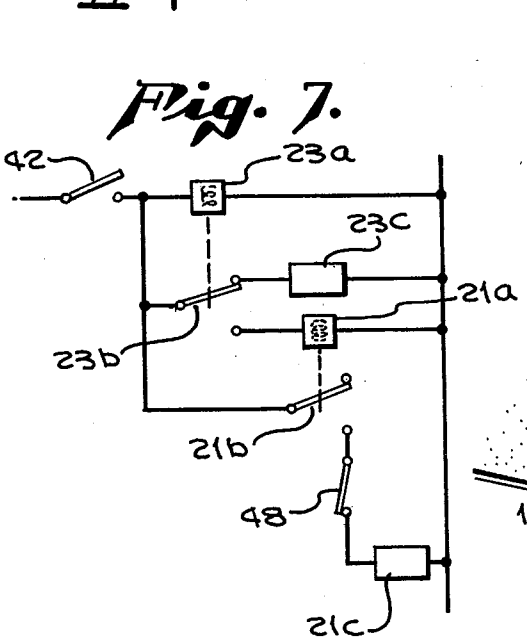
FIG. 7 is a schematic circuit diagram, for the box metering system shown in FIG. 1.
Figure 2:
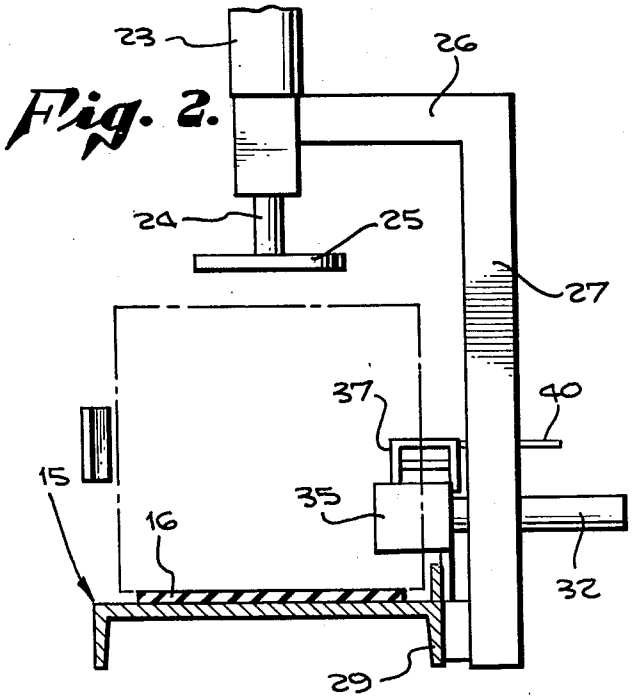
FIG. 2 is a fragmentary, sectional view taken in the plane indicated by line II — II of FIG. 1.

At the start of a box filling and weighing operation and also referring to FIG. 7, switch means 42 is normally opened and switch means 48 is normally closed. Box stop means 21 is normally in projected position to stop a box at the box stuffing station and switch member 37 carried on box stop member 35 is biased toward the advancing box. When the first box arrives at the box metering system 10, the front or leading wall of the first box is pressed against the biased switch member 37 which yields so that its switch rod 40 engages switch arm 41 to close switch 42. Closing of switch 42 completes a circuit to a time delay relay coil 23*a* for the box stuffing operation. Relay 23*a* holds relay switch 23*b* closed to complete a circuit to the air valve 23*c* for causing actuation of the box stuffing cylinder 23 to complete the assembly of the two box parts prior to filling with articles.

After the selected time delay has elapsed, relay switch 23*b* is actuated to complete the circuit to the box stop time delay relay coil 21*a* having a relay switch 21*b* which is closed thereby to complete the circuit through normally closed switch 48 to the air valve coil 21*c* for the cylinder and piston means 32 to retract the box stop member 35.

Since there is no prior box the first box, switch 48 is normally closed and completion of the circuit through switch 21*b* causes box stop member 35 to be retracted by the cylinder and piston means 32. In box stop retracted position, the continuously moving belt on the conveyor means advances the first box towards the filling station. As the first box moves past the switch means 48 switch member 49 is engaged by the side of the box and normally closed switch 48 is opened. Box stop member 35 is projected toward the path of the boxes and may slideably engage the side wall of the box being advanced from the box stuffing station. Thus when the first box clears the box metering system 10 the box stop member 35 will press against the first box sufficiently so that it is interposed in the path of movement of the second box and serves to stop said box at the box stuffing station.

The cycle is repeated. Each time a stuffed box assembly passes beyond the contact with the switch arm 48 a box is released from the box stuffing station. It will be noted that the stuffing operation occurs immediately upon the stopping of the box by the box stop member and the position of the box is precisely determined by the box stop member. It would be apparent that under some circumstances the box stuffing operation may be completed and the box at the stuffing station ready to move before demand is made for a box at the box filling and weighing stations which would cause advancement of the boxes which had passed the switch arm 48.

In the event boxes accumulate on the downstream side of switch 48 and switch 48 is in open position because of contact of arm 49 with a box opposite arm 49, box stop member 35 will remain in projected position to keep a just completed assembled box at the box completion station until further demand is made for boxes at the box filling station.

It will thus be apparent that the box metering system 10 not only provides completion of the assembly of two part boxes at a selected point along the box feed conveyor means but also provides a box metering system responsive to the need for boxes at box filling and weighing stations and assures that the boxes are in proper assembled relation for advancement thereto.

It would be understood that modifications and changes may be made to the box metering system described above and such changes and modifications coming within the scope of the appended claims are embraced thereby.

I claim:

1. In combination with a box filling system in which a line of partially assembled two-piece boxes are advanced on a continuously moving conveyor to box filling stations, the provision of:

means to complete assembly of said two-piece boxes before reaching said filling station;

and means to meter the flow of said boxes along said line after assembly of said boxes is complete;

said box metering means including a switch means contacted by an incompletely assembled box to cause actuation of said box completion assembly means.

2. In a combination as claimed in claim 1 wherein said box completion assembly means includes a pressure fluid cylinder and piston means for pressing said box parts into complete assembly.

3. A combination as claimed in claim 1 wherein said box metering means includes a box stop member reciprocally movable into and out of the path of said line of boxes to stop and to release a box;

said switch means being carried by said box stop member for actuation by said box being stopped by said box stop member.

4. In a combination as claimed in claim 3 including a second switch means located downstream of said box stop member and normally in contact with the next box downstream in said line of boxes, said second switch means upon losing contact with said downstream box upon demand for a box at said filling station serving to cause actuation of said box stop member into a position out of the path of said line of boxes to cause release of a box for advancement toward said filling station.

5. In a box feed conveyor means, the combination of:

a box stop and assembly station including a box stop means reciprocally movable into and out of the path of a box on said conveyor means to hold and to release a box;

a box assembly means adjacent said box stop means for actuation while a box is stopped by said box stop means;

and switch means on said box stop means for engagement by a box to actuate said box assembly means.

6. In a conveyor means as claimed in claim 5 including a second switch means having a switch contact arm for engagement with a box downstream from said box stop means, said second switch means causing actuation of said box stop means to box release position in the absence of a box downstream from said box stop means.

7. A box feed conveyor means as claimed in claim 5 wherein said box assembly means includes a reciprocally movable plunger actuated by contact of said first switch means on said box stop means for completing assembly of said box.

8. A metering device for controlling the flow of boxes in a line on a box feed conveyor means comprising in combination:

a box stop member;

pressure fluid piston and cylinder means connected to said box stop member for reciprocal movement thereof into and out of the path of said boxes;

and switch means actuated by movement of said boxes to cause retraction of said box stop member to release a box.

* * * * *

UNITED STATES PATENT AND TRADEMARK OFFICE

CERTIFICATE OF CORRECTION

PATENT NO. : 4,137,830

DATED : February 6, 1979

INVENTOR(S) : Jerry L. Boyd

It is certified that error appears in the above-identified patent and that said Letters Patent are hereby corrected as shown below:

Column 3, line 26, after "suitable" insert -- source --; line 60, "Swtich" should be -- Switch --.
Column 4, line 1, "becuase" should be -- because --; line 36, after "prior box" insert -- leading --.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*